US006136489A

United States Patent [19]

Takehara

[11] Patent Number: 6,136,489

[45] Date of Patent: Oct. 24, 2000

[54] CARRIER FOR THE DEVELOPMENT OF ELECTROSTATIC IMAGE AND DEVELOPER COMPRISING SAME

[75] Inventor: Takatsugu Takehara, Niigata, Japan

[73] Assignee: Mitsubishi Chemical Corporation, Tokyo, Japan

[21] Appl. No.: 09/330,061

[22] Filed: Jun. 11, 1999

[30] Foreign Application Priority Data

Jun. 12, 1998 [JP] Japan ..... 10-165071

[51] Int. Cl.[7] ..... G03G 9/107; G03G 9/113

[52] U.S. Cl. ..... 430/108; 430/106.6

[58] Field of Search ..... 430/106.6, 108, 430/111

[56] References Cited

U.S. PATENT DOCUMENTS 4,672,016 6/1987 Isoda et al. ..... 430/108
5,885,742 3/1999 Okada et al. ..... 430/108
5,968,699 10/1999 Matsuzaki et al. ..... 430/108

FOREIGN PATENT DOCUMENTS 61-260254 11/1986 Japan .

*Primary Examiner*—John Goodrow
*Attorney, Agent, or Firm*—Oblon, Spivak, McClelland, Maier & Neustadt, P.C.

[57] ABSTRACT

Disclosed is a carrier for the development of an electrostatic image comprising a magnetic metal or oxide thereof incorporated therein as a core material, the core material being coated with a resin, wherein the following relationships (1) and (2) are satisfied:

$$0.5\times10^{-2}\leqq Wc/Wo\leqq1.6\times10^{-2} \quad (1)$$

$$1.0\times10^{-2}\leqq C\cdot Wc/(Wo+Wc)\leqq4.3\times10^{-2} \quad (2)$$

wherein Wc is the weight (g) of the resin coated on the carrier core material; Wo is the weight (g) of the carrier core material; and C is the carbon concentration (mg/g) in the carrier.

9 Claims, No Drawings

CARRIER FOR THE DEVELOPMENT OF ELECTROSTATIC IMAGE AND DEVELOPER COMPRISING SAME

FIELD OF THE INVENTION

The present application is based on Japanese Application No. Hei. 10-165071, which is incorporated herein by reference.

The present invention relates to an carrier for the development of an electrostatic image for use in copying machines or printers employing electrophotography, i.e., coated carrier which forms a dry process two-component developer with a toner.

BACKGROUND OF THE INVENTION

Development processes by electrophotography include a two-component development process using a developer made of two components, i.e., toner particles and carrier, such as magnetic brush process and cascade process. In general, such a two-component development process developer is a mixture of a toner made of fine particles and a carrier made of particles having a greater size. Due to electrostatic charge having opposing polarities developed by the contact of these particles, when a developer having toner particles retained on the surface of a carrier comes in contact with an electrostatic image on the photoreceptor, the toner particles are attracted by the electrostatic image to form a visible image. The visible image thus formed is transferred to an image support such as paper, and then fixed thereto under heating or pressure.

The quality of the electrostatic image thus formed (image quality) depends on the triboelectricity and resistivity of the carrier and toner, particularly on the material of the carrier core material and the core coating resin layer. In general, as the triboelectricity of the carrier increases, the image density decreases. Further, the carrier can be more easily attracted by the photoreceptor, causing image defects. On the other hand, if the triboelectricity of the carrier is reduced, fog or stain in the interior of the copying machine due to toner scattering can occur more. Further, if the resistivity of the carrier is too high, the resulting image density is limited to a low level or gradually decreases or some edge effect can occur. Moreover, if the resistivity of the carrier is too low, a high image density can be obtained but further generation of fog, reduction of gradation or toner stain in the interior of the copying machine can easily occur.

The optimization of the triboelectricity and resistivity of the carrier has heretofore been accomplished by forming the carrier core material by iron, ferrite, magnetite, hematite or the like or by forming the carrier core coating resin layer by a silicone resin, acrylic resin, polyolefin resin, vinyl resin, polyvinylidene resin, fluorocarbon resin, polyamide resin, polyester resin, polyurethane resin, polycarbonate resin, phenolic resin, melamine resin, amino resin, epoxy resin or the like and incorporating an electrically conductive powder such as carbon black and organic tin compound in the coating layer on the carrier core material or by changing the thickness of the coating layer. However, even if these factors are merely combined, an image with a high density, little fog and a high gradation which are well balanced cannot be easily obtained. Thus, the foregoing approach is disadvantageous.

SUMMARY OF THE INVENTION

An object of the present invention is to provide a carrier for the development of an electrostatic image which can provide a stabilized high image quality (high image density, minimized occurrence of fog, high gradation) and accomplish a minimized occurrence of toner scattering (little staining in the interior of copying machine due to toner scattering).

In order to solve the foregoing problems, the inventor repeatedly made various experimental analysis. As a result, paying their attention to the weight of the coating layer on the carrier core material and the amount of electrically-conductive fine powder contained in the coating layer on the carrier core material, the inventors successfully obtained a developer which provides a high image density, low fog, high gradation and low toner scattering which are well balanced.

The present invention provides a carrier for the development of an electrostatic image comprising a magnetic metal or oxide thereof incorporated therein as a core material, said core material being coated with a resin, wherein the following relationships (1) and (2) are satisfied:

$$0.5\times10^{-2}\leqq Wc/Wo\leqq1.6\times10^{-2} \quad (1)$$

$$1.0\times10^{-2}\leqq C\cdot Wc/(Wo+Wc)\leqq4.3\times10^{-2} \quad (2)$$

wherein Wc is the weight (g) of the resin coated on the carrier core material; Wo is the weight (g) of the carrier core material; and C is the carbon concentration (mg/g) in the carrier.

DETAILED DESCRIPTION OF THE INVENTION

The present invention will be further described hereinafter.

As the carrier core material made of a magnetic metal or oxide thereof employable herein there may be used any known conventional material such as ferrite, magnetite and iron. The particle diameter of the core material is preferably from 30 $\mu$m to 200 $\mu$m, particularly from 60 $\mu$m to 120 $\mu$m. Referring to the particle diameter distribution, the proportion of particles having a diameter of not more than 45 $\mu$m is preferably not more than 5.0% by weight, more preferably not more than 3.0% by weight. The saturated magnetization of the carrier core material may be from 50 to 95 emu/g, preferably from 55 to 75 emu/g.

Examples of the material of the coating layer on the carrier core material include silicone resin, acrylic resin, fluororesin, polyolefin resin, vinyl resin, polyvinylidene resin, fluorocarbon resin, polyamide resin, polyester resin, polyurethane resin, polycarbonate resin, phenolic resin, melamine resin, amino resin, and epoxy resin. Preferred among these materials are fluororesin, acrylic resin, and silicone resin. Particularly preferred among these materials is silicone resin.

In the present invention, a material having a carbon-based electrically conductive material such as carbon black incorporated therein may be used. The incorporation of such an electrically conductive material makes it possible to reduce the specific resistivity of the carrier. In particular, the specific volume resistivity at an applied voltage of 100 V is preferably not more than $5.0\times10^{9}$ $\Omega\cdot$cm.

For the measurement of the weight Wo of the carrier core material according to the foregoing relationship, 5 g of the carrier is ultrasonically cleaned with 50 ml of THF in a beaker until the coating layer on the core is thoroughly eluted. The carrier is separated from the solution, dried, and then measured for weight. Wc is the value obtained by subtracting Wo from the weight of the carrier (5 g). Accordingly, Wc/Wo represents the proportion of the resin coated on the carrier core material per unit weight of the carrier. If Wc/Wo falls below $0.5\times10^{-2}$, the effect of the carrier core material is enhanced, raising the triboelectricity of the carrier. The resulting developer exhibits a raised triboelectricity and thus gives a lowered image density. Further, the carrier can be attached to the photoreceptor. On the contrary, if Wc/Wo exceeds $1.6\times10^{-2}$, the resulting deterioration of the fluidity of the carrier or other defects cause the deterioration of the triboelectricity of the carrier. The resulting developer exhibits a deteriorated triboelectricity, giving an image with remarkably worsened fog and lowered gradation and causing the interior of copying machine to be remarkably stained with the toner.

C·Wc/(Wo+Wc) is a parameter indicating the electrical conductivity of the carrier. The carbon concentration C in the carrier is the weight (mg) of carbon contained per unit weight (g) of the carrier as determined by means of a Type EMIA-110 carbon-in-meal analyzer produced by HORIBA, Ltd. If C·Wc/(Wo+Wc) falls below $1.0\times10^{-2}$, the resulting carrier exhibits a high resistivity. The resulting developer gives an image with a limited or lowered density or exerts an edge effect. On the contrary, if C·Wc/(Wo+Wc) exceeds $4.3\times10^{-2}$, the resulting carrier exhibits a lowered resistivity, causing an increased occurrence of fog, reduction of gradation and scattering of toner that stains the interior of copying machine. Accordingly, assuming that Wo is the weight of the carrier core material, Wc is the weight of the resin coated on the carrier core material and C is the carbon concentration in the carrier, if Wc/Wo is from $0.5\times10^{-2}$ to $1.6\times10^{-2}$ and C·Wc/(Wo+Wc) is from $1.0\times10^{-2}$ to $4.3\times10^{-2}$, a carrier which can form a developer that gives an image with a high density and little fog and causes little toner or carrier scattering can be obtained. C·Wc/(Wo+Wc) is preferably from $1.0\times10^{-2}$ to $4.0\times10^{-2}$.

In the foregoing relationship (2), the carbon concentration is the concentration of carbon atom not only in the carbon-based electrically conductive material but also in the resin compound is calculated, of course. Therefore, the range of the carbon concentration is predetermined herein taking into account the carbon concentration in the resin compound.

The combination of the foregoing carrier with a toner makes it possible to obtain a two-component developer.

As the resin in which the toner employable with the developer of the present invention is incorporated there may be used any known resin suitable for toner for the development of an electrostatic image.

Examples of styrene resin (homopolymer or copolymer containing styrene or substituted styrene), if used, include polystyrene, chloropolystyrene, poly-α-methylstyrene, styrene-chlorostyrene copolymer, styrene-propylene copolymer, styrene-butadiene copolymer, styrene-vinyl chloride copolymer, styrene-vinyl acetate copolymer, styrene-acrylic ester copolymer (e.g., styrene-methyl acrylate copolymer, styrene-ethyl acrylate copolymer, styrene-butyl acrylate copolymer, styrene-octyl acrylate copolymer, styrene-phenyl acrylate copolymer), styrene-methacrylic ester copolymer (e.g., styrene-methyl methacrylate copolymer, styrene-ethyl methacrylate copolymer, styrene-butyl methacrylate copolymer, styrene-phenyl methacrylate copolymer), styrene-methyl chloroacrylate copolymer, and styrene-acrylonitrile-acrylic ester copolymer.

Preferred among these resins are styrene resin, saturated or unsaturated polyester resin, and epoxy resin. These resins may be used not only singly but also in combination. Particularly preferred among these resins are styrene resin and polyester resin.

The flow softening temperature (Tm) of such a resin is preferably from about 80° C. to about 150° C., more preferably from about 90° C. to about 140° C. If Tm falls below 80° C., it is favorable in the temperature of fixing on paper but can cause hot offset. Further, the resulting toner can be easily fractured inside the developing tank. Accordingly, spent, i.e., phenomenon in which a toner is fixed to the surface of carrier or doctor blade, can occur, causing deterioration of triboelectricity and hence deterioration of durability of developer. On the contrary, if Tm exceeds 150° C., the temperature of fixing on paper is too high. Further, the resulting toner exhibits a deteriorated toner grindability.

The glass transition temperature of the resin is preferably not lower than 45° C. If the glass transition temperature of the resin falls below 45° C., the resulting toner exhibits a deteriorated storage stability. For example, it can be strongly agglomerated or fixed after prolonged storage at a temperature of 40° C. Further, a toner agglomerate can be easily produced at the externally addition step. Moreover, the resin can be easily attached to the screen, side wall or other parts of a seiving equipment to produce a toner agglomerate. Further, the toner has some disadvantages in use. For example, the toner can be easily fixed to parts of the developing machine such as bearing and doctor blade after prolonged use in the developing machine.

The preparation of the resin can be accomplished by any known method. For example, if a styrene resin is prepared, solution polymerization, suspension polymerization, bulk polymerization, emulsion polymerization or the like may be employed. If necessary, low molecular polymer and macro molecular polymer may be prepared by different polymerization methods.

The various testing methods on the resin to be used herein will be described hereinafter.

[Flow softening temperature (Tm)]

Using a Type CFT-500 flow tester produced by Shimadzu Corp., 1 g of the specimen is pre-heated at a rate of 3° C./min to a temperature of 50° C. in 5 minutes under a load of 30 kg with a die having a nozzle size of 1 mm×10 mm during measurement. In some detail, the temperature at the point intermediate between the beginning of flow and the termination of flow is defined as flow softening temperature (Tm).

[Glass transition temperature (Tg)]

Using a DTA-40 differential thermal analyzer produced by Shimadzu Corp., the specimen is measured at a heat rising rate of 10° C./min. A tangent line is then drawn on the characteristic curve on the position at transition (inflection) begins. The temperature at the intersecting point is defined as glass transition temperature (Tg).

The colorant to be used with the carrier of the present invention is not specifically limited so far as it has been heretofore used. Any proper pigments or dyes may be used. For example, titanium oxide, zinc oxide, alumina white, calcium carbonate, Prussian blue, magnetite, carbon black, phthalocyanine blue, phthalocyanine green, hansa yellow G, rhodamine pigment, chrome yellow, quinacridone, benzidine yellow, rose bengal, triallylmethane dye, anthraquinone dye, monoazo and disazo pigment, etc. may be used singly or in combination to provide a desired toner color.

The content of the colorant is arbitrary so far as it suffices to color the toner such that a visible image can be formed by development. The amount of carbon black to be incorporated in the toner is closely related to the triboelectricity or resistivity of the toner.

Further, if necessary, the toner may have a small amount of auxiliary incorporated therein for the purpose of improving the thermal properties, physical properties, releasability, etc. of the toner. For example, polyalkylene wax, paraffin wax, higher fatty acid, fatty amide, metal soap, etc. may be used. The amount of such an auxiliary to be incorporated is preferably from 0.1 to 10 parts by weight based on 100 parts by weight of the toner particles.

Moreover, the toner may have known positively or negatively chargeable charge control agents incorporated therein singly or in combination for the purpose of adjusting the triboelectricity of the toner. If the toner is positively chargeable, a proper amount of a charge control agent such as nigrosine dye, quaternary ammonium salt, triaminotriphenyl methane compound and imidazole compound may be added. If the toner is negatively chargeable, a proper amount of a charge control agent such as metal-containing azo dye, salicylic acid metal complex, alkylsalicylic acid metal complex and calixarene compound may be added. The amount of such a charge control agent to be incorporated is preferably from 0.05 to 10 parts by weight based on 100 parts by weight of the resin.

As other additives there may be used inorganic fine powder for polishing the toner composition attached to the surface of the photoreceptor. Examples of the inorganic fine powder include iron oxide, chromium oxide, calcium titanate, magnesium titanate, cerium oxide, zirconium oxide, aluminum oxide, titanium oxide and zinc oxide. The inorganic fine powder may be used singly or in admixture in an amount of from 0.05 to 10 parts by weight based on 100 parts by weight of the toner. The inorganic fine powder may be subjected to surface treatment with a silane coupling agent, titanate coupling agent, silicone oil, styrene resin containing amino group or the like for the purpose of adjusting resistivity or improving hydrophobicity, triboelectricity, etc.

Further, the inorganic fine powder is preferably used in combination with at least one non-magnetic powder selected from the group consisting of silicon oxide powder, titanium oxide powder, aluminum oxide powder, zinc oxide powder and magnesium oxide powder for the purpose of improving the fluidity of the toner. In particular, the recent tendency is toward smaller toner particle diameter with the enhancement of image quality. The combined use of the inorganic fine powder and the non-magnetic powder is effective when the toner particle diameter is from 3 to 12 $\mu$m, preferably from 3 to 10 $\mu$m.

The inorganic fine powder to be used in the present invention preferably has a specific surface area of from 10 to 500 $m^2/g$ as determined by BET method. The predetermination of the specific surface area of the inorganic fine powder to the above defined range makes it possible to improve the storage stability of the toner, the suppliability of the toner from the toner feeding zone, the conveyability of the toner in the development zone, etc. If the specific surface area of the inorganic fine powder falls below 10 $m^2/g$, the resulting toner cannot be provided with sufficiently improved fluidity and conveyability. On the other hand, if the specific surface area of the inorganic fine powder exceeds 500 $m^2/g$, the effect of separating the toner particles from each other is lessened, making the toner more liable to agglomeration or fixing during storage at high temperatures. Further, the resulting toner can form a film on a photoreceptor such as organic photoconductor.

The non-magnetic powder is preferably subjected to hydrophobic treatment on the surface thereof with a known treatment and by a known method. This hydrophobic treatment makes it possible to render the non-magnetic powder hydrophobic and less dependent on environment. Further, the non-magnetic powder particles can be less agglomerated. The resulting toner exhibits a remarkably improved fluidity. As the surface treatment there is preferably used a silane coupling agent. Other treatments tend to less improve the fluidity of the toner. The silane coupling agent may be used in combination with other treatments. Surface treatment may be effected on various layers. Examples of the silane coupling agent employable herein include organoalkoxysilane (e.g., methoxytrimethylsilane, dimethoxydimethylsilane, trimethoxymethylsilane, ethoxytrimethylsilane), organochlorosilane (e.g., trichloromethylsilane, dichlorodimethylsilane, chlorotrimethylsilane, trichloroethylsilane, dichlorodiethylsilane, chlorotriethylsilane, chlorotriphenyl silane), organosilazane (e.g., triethylsilazane, tripropylsilazane, triphenylsilazane, hexamethyldisilazane, hexaethyldisilazane, hexaphenyldisilazane), organodisilane, and organosilane. Particularly preferred among these silane coupling agents are organochlorosilane and organosilazane.

The amount of the non-magnetic powder to be incorporated in the toner is preferably from 0.01 to 10 parts by weight, more preferably from 0.05 to 8 parts by weight based on 100 parts by weight of the toner particles. If the amount of the non-magnetic powder falls below 0.01 part by weight, no effect of improving fluidity can be exerted. On the contrary, if the amount of the non-magnetic powder exceeds 10 parts by weight, the resulting free non-magnetic powder forms a film on the photoreceptor or can be attached to a member for charging the carrier in the two-component developer to cause the deterioration of charging function or other properties. Further, if the toner is positively chargeable, the triboelectricity of the toner is remarkably deteriorated, causing more occurrence of fog and an increase in the scattered amount of toner. If the toner is negatively chargeable, the triboelectricity of the toner is remarkably enhanced, causing the reduction of image density.

As additives for toner other than the inorganic fine powder there may be used any known inorganic or organic fine powder such as electrically conductive titanium, antimony oxide, tin oxide, cerium oxide, barium sulfate, strontium titanate, hydrotalcite compound, acryl bead, silicon bead and polystyrene bead in a proper amount, preferably from 0.005 to 8 parts by weight based on 100 parts by weight of the toner particles used.

EXAMPLES

The present invention will be further described in the following examples, but the present invention should not be construed as being limited thereto.

Carriers were prepared according to the following examples and comparative examples. By comparing these carriers in properties, the present invention will be further described.

Example 1

| | |
|---|---|
| Styrene-acrylic resin: XPA-4934 (produced by Mitsui Chemical Inc.) | 100 parts by weight |
| Metal salt of salicylic acid: E-88 (produced by Orient Chemical Industries Limited) | 1 part by weight |
| Colorant (carbon black: #25 (produced by Mitsubishi Chemical Corporation)) | 8 parts by weight |
| Low molecular polypropylene: NP505 (produced by Mitsui Chemical Inc.) | 3 parts by weight |

The mixture having the foregoing formulation was kneaded and ground by means of a continuous twin-screw extruder, and then classified to obtain a black toner having a particle diameter of about 8 $\mu$m. Using a super mixer, 100 parts by weight of the black toner were then mixed with 0.3 part by weight of a magnetite powder (KBC100, produced by KANTO DENKA KOGYO CO., LTD.) and 0.5 part by weight of a silica (R972, produced by Nippon Aerosil Co., Ltd.) to obtain a toner A. 3.63 parts by weight of the toner thus obtained were then mixed with 100 parts by weight of a carrier A having a particle diameter of about 80 μm, Wc/Wo of $0.7\times10^{-2}$ and C·Wc/(Wc+Wo) of $2.2\times10^{-2}$ comprising ferrite as a core material and a carbon-containing silicone resin as a resin for coating the surface of the carrier core material to obtain a developer A. The carrier used exhibited a specific volume resistivity of $2.9\times10^{9}$ Ω·cm at an applied voltage of 100 V.

Using a copying machine (blade cleaning and normal development process copying machine comprising an organic photoconductor as a photoreceptor and a two-component magnetic brush), the foregoing developer A and the toner A were subjected to the following copying test.

<Copying test>

A copying test was conducted over 50,000 sheets of copying paper under ordinary conditions (23° C. to 25° C., 50 to 60% RH). The results of the copying test showed that the image remained stable and good in density, prevention of fog and excellent in gradation during 50,000 sheets of copying. Further, neither stain in the interior of the copying machine due to toner scattering nor image defects due to the attachment of carrier to the photoreceptor (carrier scattering) occurred.

Example 2

3.63 parts by weight of the toner A of Example 1 were mixed with 100 parts by weight of a carrier B containing the same carrier core material as used in Example 1 and the same resin for coating the surface of the carrier core material as used in Example 1 but in an increased amount and hence showing Wc/Wo of $0.8\times10^{-2}$ and C·Wc/(Wc+Wo) of $2.3\times10^{-2}$ to obtain a developer B. The carrier used exhibited a specific volume resistivity of $1.0\times10^{6}$ Ω·cm at an applied voltage of 100 V.

The developer B and the toner A were then subjected to the same copying test as in Example 1.

<Copying test>

Good results similar to Example 1 were obtained.

Comparative Example 1

3.63 parts by weight of the toner A as used in Example 1 were mixed with 100 parts by weight of a carrier C containing the same carrier core material as used in Example 1 but coated with a silicone resin free of electrically conductive material and hence having Wc/Wo of $0.3\times10^{-2}$ and C·Wc/(Wc+Wo) of $0.8\times10^{-2}$ to obtain a developer C.

The developer C and the toner A were then subjected to the same copying test as in Example 1.

<Copying test>

From the beginning of the copying test, the image showed a low density and a lack at the rear end thereof. As the copying test proceeded, the resulting image density decreased. Further, image defects due to the attachment of carrier to the photoreceptor (carrier scattering) occurred.

Comparative Example 2

3.63 parts by weight of the toner A as used in Example 1 were mixed with 100 parts by weight of a carrier D containing a carrier core material having the same formulation as in Example 1 and a core coating resin made of the same silicone resin as used in Example 1 and the same electrically conductive material as used in Example 1 but in an increased amount and hence showing Wc/Wo of $0.8\times10^{-2}$ and C·Wc/(Wc+Wo) of $4.7\times10^{-2}$ to obtain a developer D. The carrier used exhibited a specific volume resistivity of not more than $1.0\times10^{6}$ Ω·cm at an applied voltage of 100 V.

The developer D and the toner A were subjected to the same copying test as in Example 1.

<Copying test>

From the beginning of the copying test, the image showed much fog. As the copying test proceeded, fog occurred much more and gradation was deteriorated. Further, after 20,000 sheets of copying, remarkable stain due to toner scattering occurred at the bottom of the developing machine and at the both ends of the copying paper conveyor zone positioned below the developing machine in the interior of the copying machine.

Example 3

3.63 parts by weight of the toner A as used in Example 1 were mixed with 100 parts by weight of a carrier E containing a carrier core material having the same formulation as in Example 1 and a core coating resin made of the same silicone resin as used in Example 1 and the same electrically conductive material as used in Example 1 but in an amount intermediate between Example 1 and Comparative Example 2 and hence showing Wc/Wo of $0.8\times10^{-2}$ and C·Wc/(Wc+Wo) of $4.0\times10^{-2}$ to obtain a developer E. The carrier used exhibited a specific volume resistivity of not more than $1.0\times10^{6}$ Ω·cm at an applied voltage of 100 V.

The developer E and the toner A were subjected to the same copying test as in Example 1.

<Copying test>

The initial image showed a good density and little fog. When the copying test was effected over 20,000 sheets of paper, the image showed a little fog and a poor gradation as compared with the initial image. Up to 50,000 sheets, no further deterioration of image quality occurred. A slight stain due to toner scattering occurred at the bottom of the developing machine and at the both ends of the copying paper conveyor zone positioned below the developing machine in the interior of the copying machine.

TABLE 1

| | Wc/Wo | CWc/ (Wo + Wc) |
|---|---|---|
| Example 1 | $0.7\times10^{-2}$ | $2.2\times10^{-2}$ |
| Example 2 | $0.8\times10^{-2}$ | $2.3\times10^{-2}$ |
| Comparative Example 1 | $0.3\times10^{-2}$ | $0.8\times10^{-2}$ |
| Comparative Example 2 | $0.8\times10^{-2}$ | $4.7\times10^{-2}$ |
| Example 3 | $0.8\times10^{-2}$ | $4.0\times10^{-2}$ |

TABLE 2

| | Image density | Fog | Toner stain in copying machine | Carrier scattering | Gradation |
|---|---|---|---|---|---|
| Example 1 | Good | Good | No | Slight | Good |
| Example 2 | Good | Good | No | Slight | Good |
| Comparative Example 1 | Poor | Good | No | Remarkable | Good |
| Comparative Example 2 | Good | Poor | Remarkable | Remarkable | Poor |
| Example 3 | Good | Good | Slight | Slight | Good |

The carrier for the development of an electrostatic image according to the present invention can provide a developer having a proper triboelectricity and electrical resistance which can give an image with a high density, little fog and an excellent gradation with little stain due to toner scattering in the interior of copying machine and without causing image defects due to the attachment of carrier to the photoreceptor.

While the invention has been described in detail and with reference to specific embodiments thereof, it will be apparent to one skilled in the art that various changes and modifications can be made therein without departing from the spirit and scope thereof.

What is claimed is:

1. A carrier for the development of an electrostatic image comprising a magnetic metal or oxide thereof incorporated therein as a core material, said core material being coated with a resin, wherein the following relationships (1) and (2) are satisfied:

$$0.5\times10^{-2}\leqq Wc/Wo\leqq1.6\times10^{-2} \quad (1)$$

$$1.0\times10^{-2}\leqq C\cdot Wc/(Wo+Wc)\leqq4.3\times10^{-2} \quad (2)$$

wherein Wc is the weight (g) of the resin coated on the carrier core material; Wo is the weight (g) of the carrier core material; and C is the carbon concentration (mg/g) in the carrier;

wherein said carrier exhibits a specific volume resistivity of not more than $5.0\times10^{9}$ Ω·cm at an applied voltage of 100 V; and wherein said carrier further comprises carbon black.

2. The carrier for the development of an electrostatic image according to claim 1, wherein the following relationship (3) is satisfied:

$$1.0\times10^{-2}\leqq C\cdot Wc/(Wo+Wc)\leqq4.0\times10^{-2} \quad (3)$$

wherein Wc is the weight (g) of the resin coated on the carrier core material; Wo is the weight (g) of the carrier core material; and C is the carbon concentration (mg/g) in the carrier.

3. The carrier for the development of an electrostatic image according to claim 1, wherein said resin comprises silicone incorporated therein.

4. The carrier for the development of an electrostatic image according to claim 1, which has an average particle diameter of from 60 μm to 120 μm.

5. The carrier for the development of an electrostatic image according to claim 4, comprising particles having a diameter of not more than 45 μm in a proportion of not more than 3.0% by weight.

6. The carrier for the development of an electrostatic image according to claim 1, which has a saturated magnetization of from 50 to 90 emu/g.

7. A two-component developer comprising at least a carrier for the development of an electrostatic image and a toner, wherein said carrier comprises a magnetic metal or oxide thereof incorporated therein as a core material, said core material being coated with a resin, and the following relationships (1) and (2) are satisfied:

$$0.5\times10^{-2}\leqq Wc/Wo\leqq1.6\times10^{-2} \quad (1)$$

$$1.0\times10^{-2}\leqq C\cdot Wc/(Wo+Wc)\leqq4.3\times10^{-2} \quad (2)$$

wherein Wc is the weight (g) of the resin coated on the carrier core material; Wo is the weight (g) of the carrier core material; and C is the carbon concentration (mg/g) in the carrier;

and wherein said carrier exhibits a specific volume resistivity of not more than $5.0\times10^{9}$ Ω·cm at an applied voltage of 100 V; and wherein said carrier further comprises carbon black.

8. The two-component developer according to claim 7, wherein the resin component in said toner is a styrene resin or polyester resin.

9. The two-component developer according to claim 7, wherein the resin component in said toner exhibits a glass transition temperature of not lower than 45° C.

* * * * *